US007448103B2

(12) United States Patent
Reynolds

(10) Patent No.: US 7,448,103 B2
(45) Date of Patent: Nov. 11, 2008

(54) ENHANCED GIRDER SYSTEM

(76) Inventor: Zachary M. Reynolds, 7 Fourth St., Suite 7, Petaluma, CA (US) 94952

( * ) Notice: Subject to any disclaimer, the term of this patent is extended or adjusted under 35 U.S.C. 154(b) by 98 days.

(21) Appl. No.: 11/131,617

(22) Filed: May 18, 2005

(65) Prior Publication Data

US 2005/0257336 A1 Nov. 24, 2005

Related U.S. Application Data

(60) Provisional application No. 60/572,567, filed on May 19, 2004.

(51) Int. Cl.
*E04C 3/02* (2006.01)

(52) U.S. Cl. ..... 14/4; 14/13; 14/74.5; 52/637; 52/650.2; 52/693

(58) Field of Classification Search ..... 52/637, 52/650.1, 650.2, 650.3, 652.1, 653.1, 690, 52/693; 14/4, 13, 74.5
See application file for complete search history.

(56) References Cited

U.S. PATENT DOCUMENTS 1,990,155 A * 2/1935 Young ..... 52/724.2
2,338,468 A * 1/1944 Tench ..... 52/800.11
3,179,983 A * 4/1965 Webber et al. ..... 52/376
5,433,055 A * 7/1995 Schliep ..... 52/694
5,592,800 A * 1/1997 Koo et al. ..... 52/692
6,493,895 B1 12/2002 Reynolds ..... 14/4
7,140,158 B2 * 11/2006 Steadman ..... 52/694
2006/0156677 A1 * 7/2006 Benton ..... 52/693

* cited by examiner

*Primary Examiner*—Gary S Hartmann
(74) *Attorney, Agent, or Firm*—DLA Piper LLP (US)

(57) ABSTRACT

An enhancing mechanism to be placed primarily below the neutral axis of a girder is presented. The movement and deflection of the girder causes the enhancing mechanism to alter the bending moment distribution of the girder. The mechanism is configured so that when combined with the girder, the overall dimensions of the combined system is not much bigger than the dimensions of the girder alone. A tension member may be incorporated into the lower boundary of the enhancing mechanism, and connections are used to attach the mechanism to the girder below the neutral axis. The girder and the enhancing mechanism may be made of the same material or different materials. The compression forces developed in the long diagonal members of the enhancing mechanism become a reaction at the girder end points. A direct connection of the long diagonal members to support points load shear directly to the end supports.

61 Claims, 10 Drawing Sheets

8
500
1037
1035
1033
1031
1036
1034
1014
1025
1013
1006
7
1020
1004
1032
800
1047
1011
1030
1019
1027
1026
1018
8100
1002
1041
1017
1014
1012
1010
1016
1040
1028
1015
1

500
409
1102
410
79°
11
4
45°
1103
8
407
405
1101
1
402
2
841
403
6
402
7
8100

ENHANCED GIRDER SYSTEM

CROSS REFERENCE TO RELATED APPLICATIONS

This application claims the benefit of U.S. Provisional Application No. 60/572,567 filed on May 19, 2004 under 35 U.S.C. §119(e).

FIELD OF THE INVENTION

This invention relates generally to girders and particularly to a girder system that reduces stress and strain on a spanning girder.

BACKGROUND OF THE INVENTION

Girders, such as beam girders, I-beams, and box girders, are commonly used for construction of various structures such as bridges, roofs, and floors. A beam girder is an efficient system which transfers shear and load between the extreme upper and lower elements of the beam. However, for beam girder structures designed for a uniformly applied load per foot of bridge span, the bending moment increases by the square of the length of the structure. This rapid increase in the bending moment as a function of the structure length is disadvantageous because one way to counter the bending moment is by increasing the girder beam size, and this results in large increases in girder beam size with relatively small increase in the length of the structure. Thus, it is desirable to find a way to significantly reduce the required size of a beam girder in proportion to its length.

U.S. Pat. No. 6,493,895 to Reynolds (the '895 patent) provides a truss segment positioned on the upper side of a bridge girder. The truss segment is centered near the lengthwise midpoint of the girder and acts to counter the bending moment. The truss segment has the shape of an M with a bar across the top. The truss segment experiences strain and develops a load in its framework when the primary bridge girder bends and deflects under the load. When the primary bridge girder is subjected to a vertically downward load, the compact truss mechanism experiences compression on the vertical elements of the M, tension on the diagonal elements of the M and compression on the horizontal bar across the top of the M. In a primary bridge girder subjected to a uniformly applied vertical load, the combination of forces developed by the truss segment exerts a force couple upon the girder, within the extent of the truss mechanism, that is contrary to the bending moment of a conventionally girder. In this way, the bending and deflection of the primary bridge girder causes the boundary elements of the truss segment to oppose the bending and deflection of the primary bridge girder. This opposition reverses the bending moment at the girder's midpoint preventing the maximum bending moment of the girder from occurring at the midpoint, as in a conventional girder.

The purpose of the truss segment is not to create a geometrically rigid triangle to support bridge loads, as in a conventionally designed truss, but to alter the deflection curvature of the beam and to redistribute the bending moment through a lever type action upon the beam girder. Long diagonal segments placed at the top joints of the truss framework and extending to the end points of the girder span are placed in compression when the bridge is subjected to a load exerting a vertically downward force. This occurs in the long diagonal segments because of the vertically downward deflection of the primary bridge girder and the opposition to rotation that the truss segment itself creates in compression across its top boundary.

The effect of the action of the structural truss mechanism and the long diagonal segments that interact with the structural mechanism is to diminish the maximum bending moment of the girder, to relocate the maximum bending moment nearer to the end support point of the girder and to significantly reduce girder deflection. A truss segment, placed within the span of a girder, can be used to reduce girder stress and deflection at midspan when it is actuated by the movement and angular deflection of the primary girder. In other words, the opposing force that acts upon the primary girder by the truss mechanism is triggered by the deflection of the primary girder to which the truss segment is attached.

Although the truss segment described in the '895 patent provides a solution to the problem of countering the bending moment of a long girder without having to increase the girder size dramatically, it has its disadvantages. For example, because the truss segment is placed on top of the girder, it takes up extra space by adding depth or dimension to the total girder system. The extra space taken up above the midpoint of the girder poses an inconvenient design limitation. Furthermore, where the position of the enhancement transmits loads as shear into the girder, acting at the neutral axis rather than reacting against the girder, the girder accommodates the shear as a stress imposed upon the girder. Also, the system in the '895 patent does not provide for a differentiation of materials between the girder and its coupled enhancement as well as a standardization of connections and assembly.

A girder system that counters the bending moment like the truss segment of the '895 patent but does not suffer from the above shortcomings is desired. Also desired are: 1) a method of removing shear, initially expressed as axial compression in the enhancement structure, from being transmitted to the girder, 2) a method of merging the enhancement with the coupled girder so that different materials may be combined to achieve optimum result, and 3) a method by which connections may be standardized to allow the desirable features of compact shape, minimal transmission of shear, and easy conformance of different materials.

SUMMARY

In one aspect, the invention is a girder system for distributing a bending moment of the girder under a uniform applied load. The girder system includes a girder having a neutral axis extending through its length and an enhancing mechanism coupled to the girder at points below the neutral axis. The enhancing mechanism has 1) a first truss segment and a second truss segment positioned substantially parallel to each other, 2) a first diagonal segment and a second diagonal segment positioned between the first truss segment and the second truss segment, wherein the first diagonal segment and the second diagonal segment are coupled to the first truss segment and a second truss segment, respectively, 3) a horizontal member connecting one end of the first truss segment to one end of the second truss segment, and 4) first and second diagonal truss members coupled to the one end of the first truss member and the one end of the second truss segment, respectively, and extending in different directions than the first diagonal segment and the second diagonal segment.

Sometimes, the first and second truss segments and the first and second diagonal segments are replaced by a first and second short vertical beams having a first base and a second base, respectively. Each combination of a truss segment and a diagonal segment is replaced by a short vertical beam.

In another aspect, the invention is a girder system that includes a girder and an enhancing mechanism coupled to the girder and housed within the outer boundaries of the girder. The enhancing mechanism may be similar to the enhancing mechanisms described above.

In yet another aspect, the invention is a method of distributing a bending moment of the girder under a uniform applied load. The method includes providing a girder having a neutral axis extending through its length, providing an enhancing mechanism of the sort described above, and coupling the girder and the enhancing mechanism at points below the neutral axis.

DETAILED DESCRIPTION OF THE EMBODIMENT(S)

Figure 1:
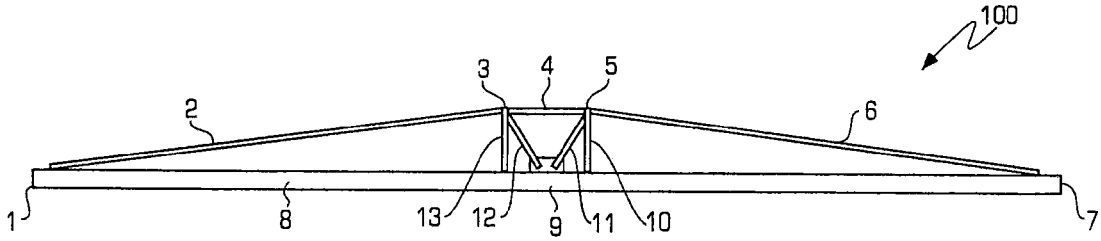
FIG. 1 (PRIOR ART)
FIG. 1 is a structural enhancement for a girder described in the '895 patent.

The following detailed description is presented to enable any person skilled in the art to make and use the invention. However, it will be apparent to one skilled in the art that the specific details are not required to practice the invention. Descriptions of specific applications are provided only as representative examples. Various modifications to the presented embodiments will be readily apparent to one skilled in the art, and the general principles defined herein may be applied to other embodiments and applications without departing from the scope of the invention. The present invention is not intended to be limited to the embodiments shown, but is to be accorded the widest possible scope consistent with the principles and features disclosed herein.

Typically, in the practice of designing axial loaded members, the line of influence of the loaded axii converge at a common point. This diminished or eliminated secondary bending stresses in the loaded members thereby optimize their column load capacities. Used with a girder, these axial line of influence normally converged with the neutral axis of the girder. This invention shows that the compact enhancing mechanism can be installed completely within the boundaries of the girder that it enhances, that the axial lines of influence do not converge with the girder neutral axis and the segment axii are offset.

The enhancing mechanism of the invention is housed substantially within the boundaries of the girder that is being enhanced. The enhancing mechanism is connected below the neutral axis of the girder, sometimes at the base of the girder, such as the lower flange or boundary. No connection is made to the top boundary of the girder nor to the top of the enhancement, thereby allowing the mechanism to flex. The compact enhancing mechanism may be supported at points along the girder web or the top boundary but without fixed at these points. The enhancing mechanism experiences strain and develops load in its framework when the primary girder bends and deflects under a load. When the primary girder is subjected to a vertically downward load, the compact truss mechanism experiences compression on the horizontal components. The horizontal components include long diagonal truss members that slope from the top of the enhancing mechanism to the bottom boundary of the girder ends. Under conventional arrangements where the enhancing mechanism is mounted on the top boundary of the girder outside of the girder boundaries, reactions are transmitted directly into the girder structure so that the girder properties are subjected to these stresses. In the invention, the enhancing mechanism is allowed to flex so that it reacts with the girder according to its purpose.

However, the invention removes a portion of the shear, created by the imposed load, and expresses this shear as a vertical reaction at the ends of the long diagonal truss members. By superposing the compact enhancing mechanism in the body of the girder, the invention allows the resulting enhanced system to be a compact unit and removes loads to the support ends, relieving the girder of the load. The invention locates the reactions of the compact enhancing mechanism below the neutral axis of the primary girder, thereby causing secondary moments in the girder that oppose the normal deflection of the girder. The secondary forces developed in the structural mechanism in the axial structure off the plane of the girder's neutral axis can aid in the reduction of overall stress in the girder. By superposing the compact truss segment within the body of the girder, the invention provides support to the compression members by the girder web, decreasing the effective column length and increasing the capacity as columns of the compression members. According to the invention, the effect of superposing the structural truss mechanism and the long diagonal segments, which interact with the structural truss mechanism, is to locate the shear component of the mechanism nearer to the end support points of the girder and to significantly reduce the girder deflection.

The invention creates a type of girder system which can be universally applied to load bearing structures where space and size limitations are important, where girder design is uncomplicated, or where the girder system benefits from using different materials in combination. As will be described in more detail, the dimensions of the enhancing mechanism may be adjustable so that it may be fitted with girders having a range of lengths and depths.

FIG. 1 shows an enhanced girder 100 of the '895 patent. The enhanced girder 100 includes a first diagonal truss member 2 having first and second ends and a second diagonal truss member 6 having first and second ends. The first end of the first diagonal truss member 2 is attached to the first end 3 of the first truss segment 13 and the second end of the first diagonal truss member 2 is attached substantially close to the first end 1 of the girder 8. The first end of the second diagonal truss member 6 is attached to the first end 5 of the second truss segment 10 and the second end of the second diagonal truss member 6 is substantially attached close to the second end 7 of the girder 8. A first end of the first diagonal segment 12 is joined with the first end 3 of the first truss segment 13, and a first end of the second diagonal segment 11 is joined with the first end 5 of the second truss segment 10.

The first diagonal truss member 2 provides an upward force applied to the second end of the first truss segment member 13 and the second diagonal truss member 6 provides an upward force applied to the second end of the third truss segment member 10 to distribute the maximum bending moment of the girder 8 toward the ends of the girder 8. The triangle formed by the first truss segment 13 and the first diagonal segment 12 and the triangle formed by the second truss segment 10 and the second diagonal segment 11 exert a prying force upon the girder 8 which opposes the normal bending of the girder 8.

Figure 2:
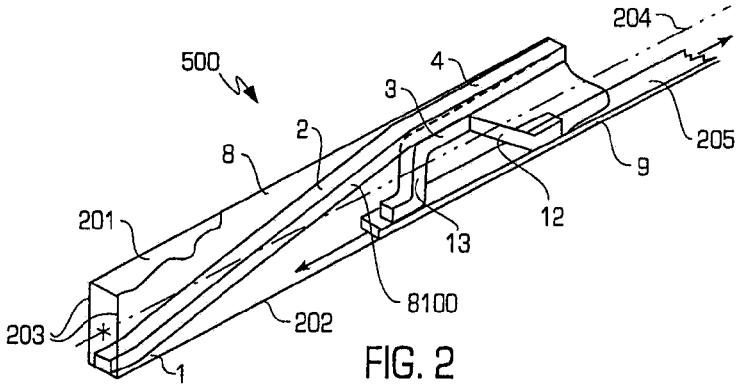
FIG. 2 shows an embodiment of a superposed enhancing segment in association with a structural tube acting as a girder.

FIG. 2 shows an enhanced girder system 500 wherein a superposed enhancing mechanism 8100 is housed generally within the boundaries of the girder 8, in accordance with the invention. The girder 8 is in the form of a structural box having a top boundary 201, a lower boundary 202, and two side boundaries 203. The first diagonal truss member 2 is connected to the girder 8 on either end of the assembly at the lower boundary 202. A horizontal member 4 extends across the girder midpoint 9 to a point 3. The first truss segment 13 rises vertically from a point located on one side of the midpoint 9. The first diagonal segment 12 rises diagonally from a point near the midpoint 9 to the join the first end 3 of the first truss segment 13. The first truss segment 13 and the first diagonal segment 12 are combined to form characteristic struts which act upon the girder 8 with a prying load, created by beam deflection.

However, in the invention, the placement of the enhancing mechanism 8100 is different from what is conventionally done since the elements of the enhancement segments (2, 4, 12, 13, 10, 11) are placed primarily below a neutral axis 204 extending through the length of the girder 8. Furthermore, the enhancing mechanism 8100 is connected to the girder 8 at points below the neutral axis 204. Typically, the enhancing mechanism is coupled to the girder along the neutral axis 204 of the beam or girder 8. The invention counter-intuitively places the enhancing mechanism 8100 primarily below the neutral axis so that displacing forces are amplified. The enhancing mechanism 8100 being positioned "primarily below the neutral axis" means the enhancing mechanism 8100 is coupled (with pins, brackets, weldments, etc.) to the girder 8 below the neutral axis so that the reaction of the girder 8 to a load is transferred to the enhancing mechanism 8100 below the neutral axis. A characteristic of the mechanism is that a tension stress is created in the girder 8 as the mechanism redistributes beam stresses and moments. Lateral displacement due to beam angular deflection is greater below the neutral axis 204. Where the enhancement segments are coupled to the girder 8 below the neutral axis 204, this amplification of forces causes an increase in the tensile component of forces that the enhancement segments create in the girder 8 by their compression and load couples. This tensile force is now located in a specific lower boundary 202 of the girder 8 and is not considered distributed in the body of the girder 8. In the invention, for the load couples to work properly with the enhancement segments loading the girder 8 below the neutral axis 204 of the girder 8, a tension chord 205 is added to the enhancement. The tension chord 205 extends across the midpoint 9 of the girder 8 to the first and second diagonal segments 11, 12 (see FIG. 1.) The enhancement segments (including 205) are connected to the girder 8 only at the points where the segments contact the lower boundary 202 of the girder 8.

The first diagonal truss member 2 is attached to the first end 3 of the truss segment member 13. The triangle, located near the midpoint 9 of the girder/mechanism formed by the first truss segment 13 and the first diagonal segment 12, is joined at the first end 3. The first diagonal truss member 2 and the horizontal member 4 are also joined at the first end 3 of the first truss segment 13. The second ends of the truss segments 13, 10 are connected to a tension chord 205 which spans the girder 8 from the first end 1 to the second end 7.

The enhancing mechanism is located substantially below the neutral axis 204 of the girder 8. The enhancing mechanism is attached to the girder using the tension chord 205 where the chord is attached to the girder 8 at the second ends of the truss segments 13, 10. The truss segments 13, 10 act through attachments upon the lower boundary 202 of the girder 8. The tension chord 205 also acts upon the girder 8.

The structural mechanism in accordance with the invention allows the girder 8 to carry a larger load compared to conventionally-designed girder/beam. The invention forms a compact unit of enhanced girder system 500. The invention adds tension elements to the enhancing mechanisms 8100 at the bottom boundary of the girder 8. The tension chords are connected to the truss segments 13, 10, which in turn are connected to the lower boundary 202 of the girder 8. A connection at the lower boundary 202 of the girder 8 for the first and second diagonal truss members 2, 6 at the girder ends 1, 7 (FIG. 1) transfers the load developed in the diagonal truss members 2, 6 directly to the beam end supports (not shown). This acts to remove shear from the beam fiber and reduces the bending moment and deflection.

Figure 3:
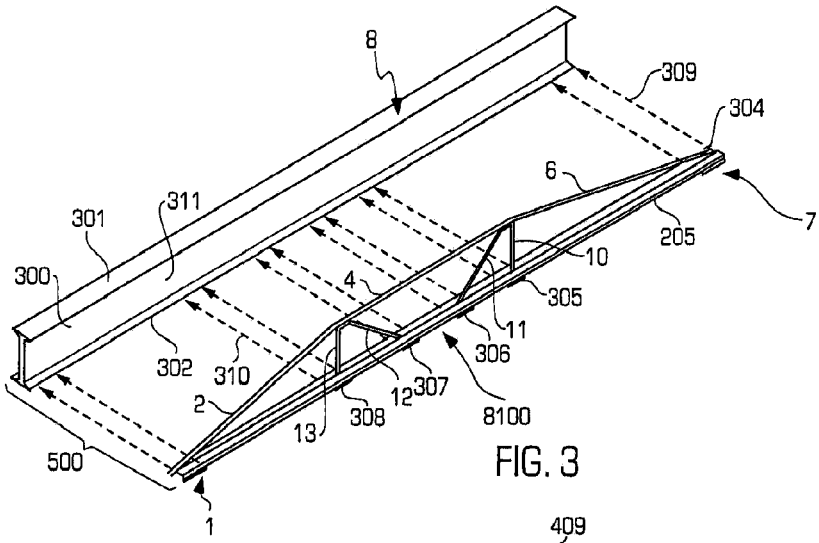
FIG. 3 shows another embodiment of a superposed enhancing segment in association with a flanged structure acting as a girder.

FIG. 3 shows another embodiment of the enhanced girder system 500 including a girder 8 and the enhancing mechanism 8100. Unlike the embodiment of FIG. 2, in which the enhancing mechanism 8100 is encased in the "box" formed by the girder 8, the girder 8 in this embodiment has open sides that allow the enhancing mechanism 8100 to slide in in the direction shown by the arrows. The girder 8 is in the form of a flanged girder, with a vertical sidewall 300, a top boundary 301, and a bottom boundary 302 composed of flanges of the girder 8 (e.g., an I beam, channel, or similar shape). The tension chord 205 acts at the bottom boundary 302 of the girder 8 and is connected to the enhancement segments 2, 6, 10, 11, 12, and 13, which in turn are connected to the bottom boundary 302 of the girder 8. Connections at the bottom boundary 302 of the girder 8 for the first and second diagonal truss members 2, 6 at the beam ends 1, 7 transfer the shear developed in the diagonal truss members 2, 6 as compression directly to the beam end supports 503, 504 (see FIG. 5). The enhancement mechanism 8100 is connected to the girder 8 at locations 305, 306, 307, and 308 at the bottom boundary 302.

The enhancing mechanism 8100 (first and second diagonal truss members 2, 6 truss segments 13, 10, diagonal segments 12, 11, and the horizontal member 4) is connected to a tension chord 205 at locations 1, 7, 304, 305, 306, 307, 308. The enhancing mechanism 8100 is connected to the girder 8 in the direction indicated by arrows 310, 309, which show the connection points of the tension chord of the enhancing mechanism 8100 to the girder lower boundary 202, such that the enhancing mechanism is supported against the sidewall 311 of the girder 8.

Figure 4:
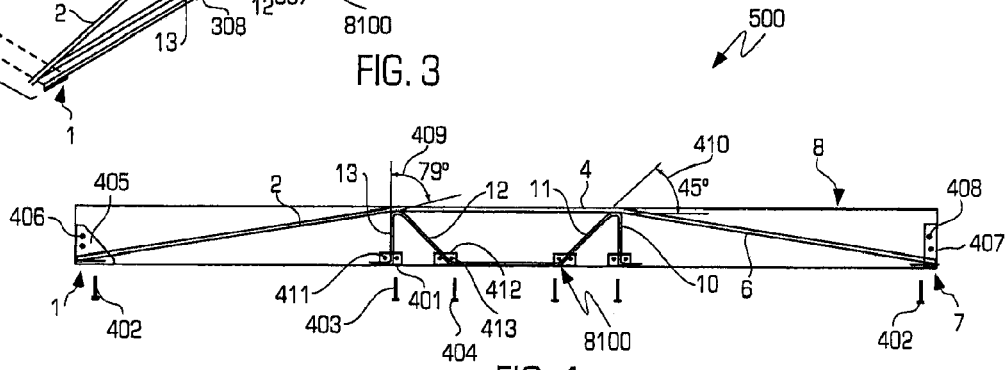
FIG. 4 is an embodiment of a superposed enhancing segment in association with a wood or timber girder.

FIG. 4 shows another embodiment of the enhanced girder system 500. In this embodiment, the girder 8 is a wood or timber girder composed of sawn lumber or composite wood material. The enhancing mechanism 8100 is attached to the girder 8 by brackets 405, 407 and saddles 412, all connected to the lower boundary 202 (see FIG. 2) of the girder 8, where the saddles may pass under and around to the opposite side of the girder 8. Each bracket is of sufficient size and strength to transfer the load developed by the first and second diagonal truss members 2, 6 into the fiber of the girder 8. Bolts or welds connect the struts to the brackets, and bolts 402, 403, 404, 406, 408, 411, 413 or welds connect the brackets 401, 405, 407, and 412 (FIG. 4) to a sidewall of the girder 8.

Although not explicitly shown in FIG. 4, tension elements 840, 841, and 842 (see FIG. 9) between the brackets 812, 813, 910, and 911 (FIG. 9) are loaded in a similar fashion to various embodiments of the invention including the one shown in FIG. 4. A tension element 841 (see FIG. 11) may also be a part of the first and second diagonal segments 11, 12 acting as extensions to these braces and connecting the braces between brackets.

In this embodiment, the girder 8 saddles the enhancing mechanism and is "inside" the enhancing mechanism. Although the enhancing mechanism is outside of the girder, the overall dimensions of the enhanced girder system 500 is not substantially different from the dimensions of the girder 8. The second end of the first diagonal truss member 2 is attached at the first end 1 of the girder 8 using a bracket assembly 405, which is attached to the girder 8 using structural pins or bolts 406, 402. The second diagonal truss member 6 is attached to the second end 7 of the girder 8 by a bracket assembly 407 attached to the girder 8 by structural pins or bolts 402, 408. The girder end brackets 405, 407 may be of the same type or different types used in combination in the arrangement. The first end of the first diagonal truss member 2 is attached to the junction of the first truss segments 13 and the first diagonal segment 12 substantially at their apex. An angle 410 that the first diagonal segment 12 makes with a line extending from the first truss segment 13 is approximately 45 degrees. Similarly, an angle 409 that the first diagonal truss member 2 makes with the extension line of the first truss segment 13 is approximately 79 degrees. The second ends of the first and second truss segments 13, 10 are connected to a bracket 401, which in turn is connected to the girder 8 using structural pins or bolts 411. The base of the bracket 401 is connected to the lower surface of the girder with structural pins or bolts 403. The second end of the second truss segment 12 is attached to a bracket 412, which in turn is connected to the girder 8 using structural pins or bolts 413. The base of the bracket 412 is connected to the bottom boundary of the girder 8 with structural pins or bolts 404. The second diagonal segment 11 and the second truss segment 10 are connected to the girder with brackets 412, 401 in substantially the same manner as the first diagonal segment 12 and the first truss segment 13. The horizontal member 4 is added to the enhancing mechanism 8100 where the first end of the horizontal member 4 is connected to the first ends of the first diagonal segment 12 and the first truss segment 13. The second end of the horizontal member 4 is connected to the first end of the second diagonal segment 11 and the second truss segment 10. The horizontal member 4 can also be an extension of the first and second truss diagonal members 2, 6, where the first end of the horizontal member 4 is connected to the first end of the first diagonal truss member 2 and the second end of the truss segment member 4 is connected to the first end of the second diagonal truss member 6.

The girder 8 may be made of a material different from that of the enhancing mechanism 8100. For example, the girder 8 may be made of wood while the enhancing mechanism 8100 is made of steel. The invention allows for two materials of different compositions to be combined in a predictable manner. This relationship can be expressed as a ratio of the deflection characteristics of each system in combination and their respective Young's modulii, so that the measure of relative stiffness can be expressed as follows:

$$f'[I/A]=\{[(E_G I_G L_S)/(L_O A_S E_S)]^{1/2}\}/L_O$$

where f' {I/A] approaching zero indicates greater stiffness, and $E_G$=Young's modulus of girder $I_G$=moment of inertia of girder Ls=combined length of struts 2, 4, and 6

Lo=total length of girder

As=area of strut

Es=Young's modulus of struts

Figure 5:
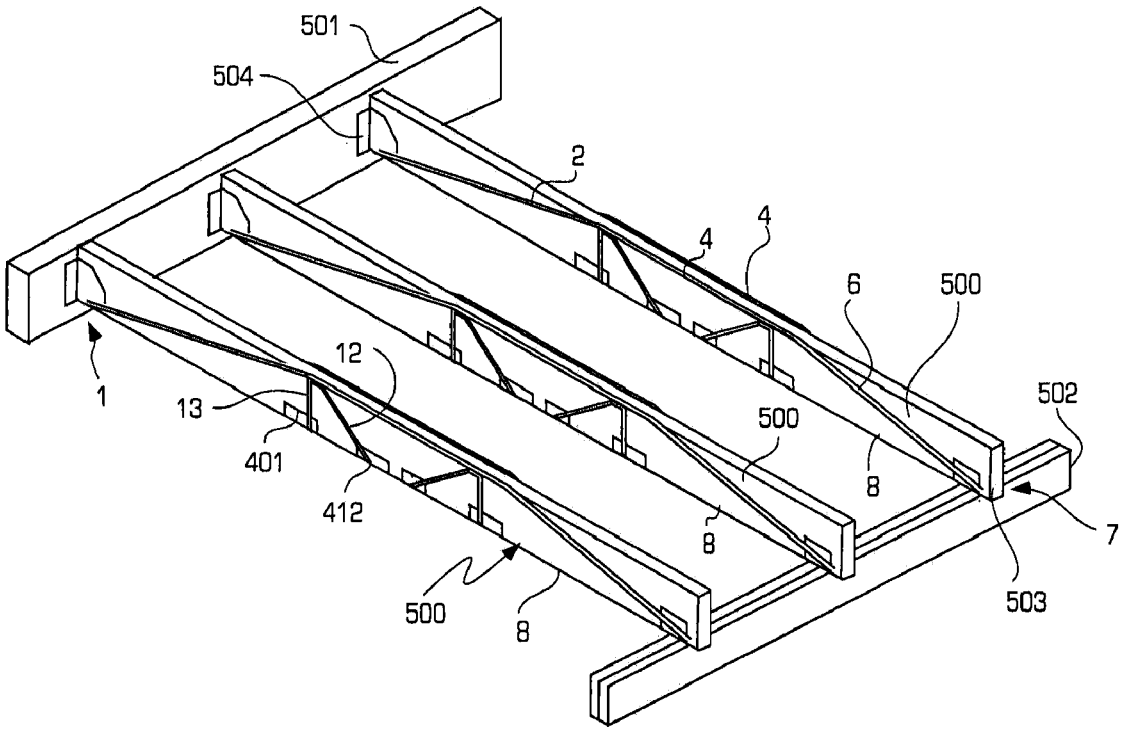
FIG. 5 is an arrangement of superposed enhanced girders installed between two end beams.

The factor of relative shear support, which the invention provides the girder, can be expressed as a ratio against a standard elevation 409 (FIG. 11) of the first and second diagonal truss members 2 and 6.

$$f(\text{theta}_2)=[\text{COS}(\text{theta}_2)''/\text{COS}(\text{theta}_2)']^2$$

where f(theta$_2$) approaching infinity indicates greater shear reduction, and (theta$_2$)'=standard elevation (theta$_2$)"=compared elevation FIG. 5 shows a plurality of enhanced girder systems 500 positioned between two end beams 501, 502. The girder 8 is shown in combination with a series of superposed enhancing mechanisms fitted on both sides of the girder sidewall, so that the enhancement is double-sided. Each side is a mirror image of the other and is composed of identical elements. The two sides may be connected through a common saddle-type bracket 401, 412 or connected separately by bolts or welds to the contiguous side of the beam or girder.

Each girder system 500 is connected to the beams by end brackets 503 and 504, depending upon the alignment and load imposed upon the girder 8. The enhancing mechanism 8100 is of the variety shown in FIG. 4, where in combination with a girder 8, it is located externally to the girder (width) dimensions, and is shown to be on both sides of the girder 8. The horizontal member 4 of the enhancing mechanism 8100 is visible from the top view. The first truss segment 13 and the first diagonal segment 12 extend upwards from the bottom of the girder 8 where they are fastened to the girder 8 by brackets 401, 412. The end bracket 504 offers support to the enhancing mechanism 8100 in combination with the girder 508 such that the girder end 1 can be considered fixed. The end bracket 503 offers support to the enhancing mechanism 8100 in combination with the girder 508 such that the girder end 7 can be considered simply supported, not fixed. The diagonal truss members 2, 6 are connected to the first and second ends of the horizontal member 4 to form a continuous structure.

Figure 6:
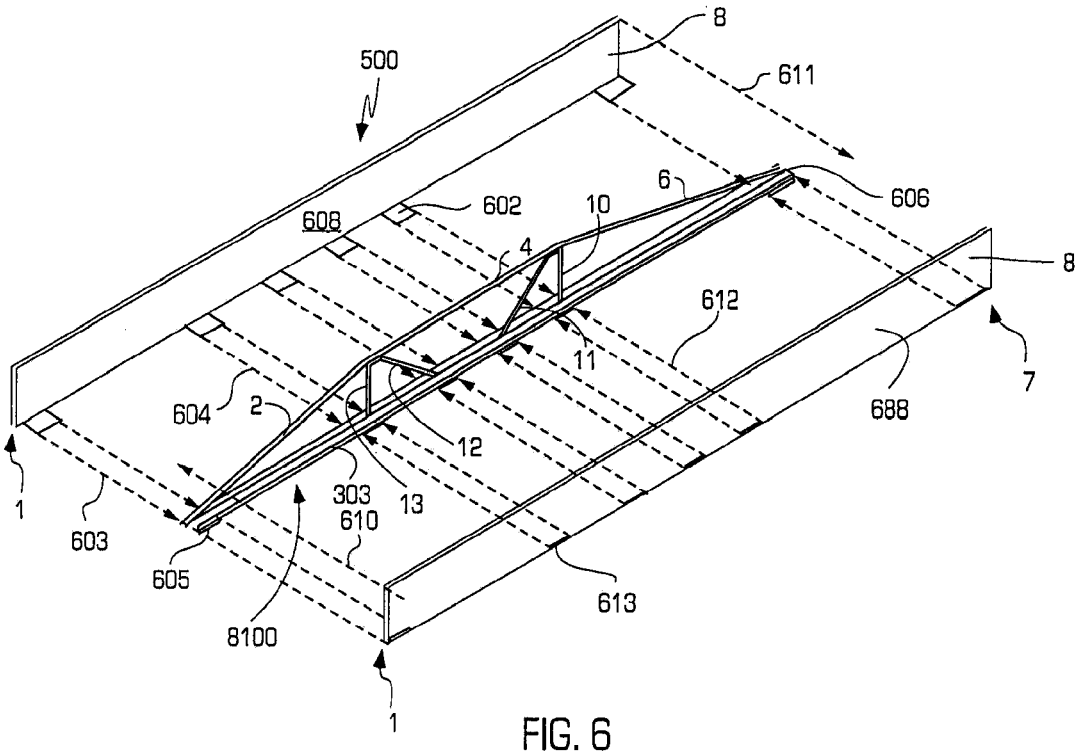
FIG. 6 is an embodiment of a superposed enhanced girder including an enhancing mechanism that is contained within the boundaries of two sidewalls that combine to form a girder.

FIG. 6 shows an enhanced girder including the enhancing mechanism 8100 and a girder 8 composed of two sidewalls 608, 688. The sidewalls 608, 688 are vertical web members. As described above in reference to FIG. 2, the enhancement consists of the first diagonal truss member 2 having a first end and a second end and the second diagonal truss member 6 having a first end and a second end, the first truss segment 13, the first diagonal segment 12, a second diagonal segment 11, a second truss segment 10, and a horizontal member 4. In addition, the enhancing mechanism 8100 includes a tension bar 303 with first and second ends where the first end 605 is connected to the second end of the first diagonal truss member 2 and the second end 606 is connected to the second end of the second diagonal truss member 6. The segments 13, 12, 11, and 10 are also connected to the tension bar 303 where their second ends meet the tension bar 303. The sidewall 608 is provided with tabs 602 at each position along its length on the bottom edge or flange so that the tabs align with the positions where the enhancement members 2, 6, 13, 12, 11, 10 contact the bar 303. The tabs 602 extend from one part of the sidewall 608 forming a web to the other part 613 of the sidewall 688 forming the second web, by moving the sidewalls 608, 688 in the direction of the arrows 604, 612. The girder sidewalls 608, 688 nearly meet at their ends 1, 7 when combined as shown by arrows 610, 611.

Figure 7:
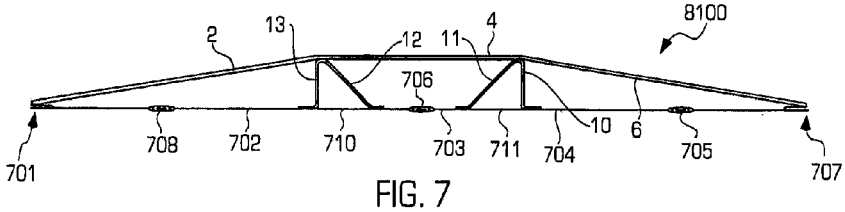
FIG. 7 shows an arrangement of an enhancing mechanism including tension chords.

FIG. 7 is a diagram of the enhancing mechanism 8100 including tension chords 702, 703, 704, 710. The second end of the first diagonal truss member 2 is connected to a first structural piece 701. A first bottom tension chord 702 with a first end and a second end has the first end connected to the first structural piece 701 and its second end connected to the second end of the first truss segment 13. Somewhere on the first tension chord 702 (e.g., substantially at the midpoint of the first tension chord 702) is located a turnbuckle, screw or other type of first tensioning device 708 that can be drawn up to adjust the tension level of the first bottom tension chord 702. A second bottom tension chord 703 with a first and second end has a first end connected to the second end of the first diagonal segment 12 and a second end connected to the second end of the second diagonal segment 11. Somewhere on the second tension chord 703 (e.g., substantially at the midpoint) is located a turnbuckle, screw or other type of second tensioning device 706 that can be used to adjust the tension level of the second tension chord 703. A third bottom tension chord 704 with a first and second end has a first end connected to the second end of the fourth truss segment 10 and its second end connected to the structural piece 707. A third tensioning device 705 (e.g., a turnbuckle, screw, etc.) is located somewhere along the third bottom tension chord 704 (e.g., substantially at midpoint of the third tension chord 704) to adjust the tension level of the third tension chord 704.

The second end of the second diagonal truss member 6 is connected to a second structural piece 707. A first end of a fourth tension chord 710 is connected with the second end of the first truss segment 13 and a second end of the fourth tension chord 710 is connected with the second end of the first diagonal segment 12. A first end of a fifth tension chord 771 is connected with the second end of the second diagonal segment 11, and a second end of the fifth tension chord 711 is connected with the second end of the second truss segment 10.

Figure 8:
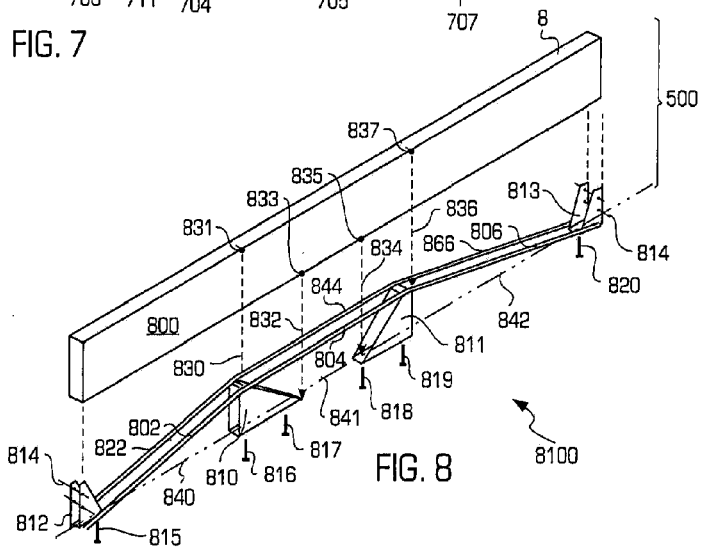
FIG. 8 shows an arrangement of the enhancing mechanism having connections and saddles for housing the primary girder.

FIG. 8 shows the enhanced girder system 500 including a girder 8 having a sidewall 800. Projection lines 830, 832, and 836 indicate how the girder 8 is assembled with the enhancing mechanism 8100 by being saddled inside the enhancing mechanism 8100. In this arrangement, the enhancing mechanism 8100 "cages" or "frames" the girder 8 and is external to the girder 8. The structure of the enhancing mechanism 8100 is shown to include a first diagonal truss member 802 and a first parallel companion truss member 822, a second diagonal truss member 806 and a second parallel companion truss member 866, all of which are outside the dimensions of the girder 8 and each having first and second ends. The structure of the enhancing mechanism 8100 includes the first and second a vertical beams 810, 811. The presence of the first and second short vertical beams 810, 811, respectively, eliminates the need for the first and second diagonal segments 12, 11, respectively. Each short vertical beam 810, 811 has a polygonal shape (e.g., triangular, trapezoidal, rectangular) with a base and a first end and a second end. The first end of the first short vertical beam 810, which is located near the first base, connects to a base of the girder 8 using structural pins or bolts 816, 817 and the second end of the first short vertical beam 810 connects to the first end of the first diagonal truss members 802 and its parallel companion truss member 822, as well as to the first ends of the horizontal member 804 and a companion horizontal member 844, which are parallel to each other. Each member and its companion member are separated by a predetermined distance that is approximately equal to the thickness of the girder 8, allowing the girder to be positioned between the members and their companion members.

The first end of the second short vertical beam 811, which is located near the second base of the short vertical beam 811, connects to the girder 8 using structural pins or bolts 818, 819. The second end of the second short vertical beam 811 connects to the first end of the second diagonal truss member 806 and its companion truss member 866 as well as to the second ends of the horizontal member 804 and the companion horizontal member 844. The first diagonal truss members 802 and its parallel companion truss member 822 are connected to a bracket assembly 812 at their second ends. The bracket assembly 812 is connected to the girder 8 and the girder web 800 using structural pins or bolts from the side 814 and/or from the bottom 815. The second diagonal truss member 806 and its companion truss member 866 are connected to a bracket assembly 813 at their second ends. The bracket assembly 813 is connected to the girder 8 and the girder web 800 using structural pins or bolts from the side 814 and/or the bottom 820.

The first and second short vertical beams 810, 811 each has a supporting base that is connected to the first and second base. The supporting bases connect the first short vertical beam 810 to the second short vertical beam 811, and are configured to form a saddle that can support the girder 8 when it is positioned within the confines of the short vertical beams 810, 811. The bottom boundary 833, 835 of the girder 8 aligns with the supporting base of the first and second short vertical beams 810, 811 as shown by the broken lines 832, 834. The top boundary or surface 831, 837 of the girder 8 aligns with the top of the first and second short vertical beams 810, 811 as shown by the broken lines 830, 836. The enhancing mechanism 8100 fits substantially within the dimensions of the girder 8 and does not project above the top boundary of the girder 8.

The first and second ends of a first bottom tension chord 840 are connected to a first end bracket 812 and the first end of the first short vertical beam 810, respectively. Similarly, the first and second ends of a second bottom tension chord 841 are connected to the first end of the first short vertical beam 810 and first end of the second short vertical beam 811, respectively. Likewise, the first and second ends of a third bottom tension chord 842 are connected to the first end of the first short vertical beam 811 and a second end bracket 813, respectively.

Figure 9:
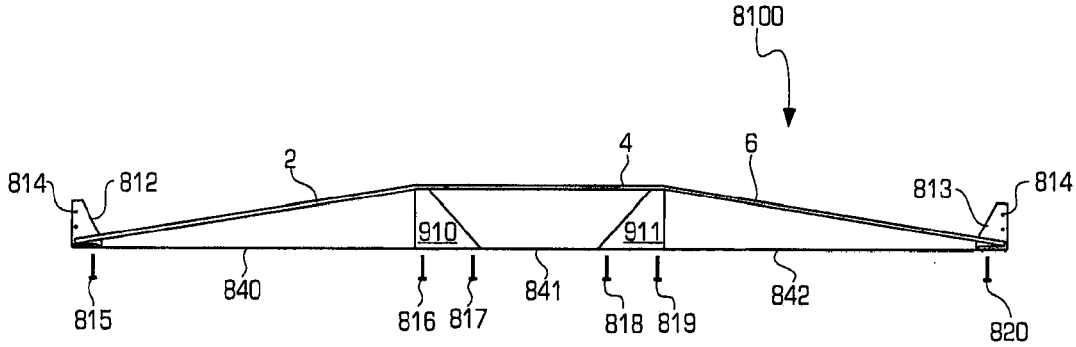
FIG. 9 is an arrangement showing the saddles and connections associated with the enhancing mechanism that connect to the primary girder.

FIG. 9 shows an enhancing mechanism 8100 including the first diagonal truss member 2, the horizontal member 4, and the second diagonal truss member 6 forming a continuous structure. The continuous structure extends from the first end of the first diagonal truss member 2 at a first end bracket 812 to the second end of a second end bracket 813. The continuous structure is connected to the first end bracket 812 and the second end bracket 813 using structural pins, bolts or weldments. The continuous structure is connected to a first and second short vertical beams 910, 911, which are polygonal in shape, at the top where the first and second diagonal truss members 2, 6 join the horizontal member 4. The second end of the first short vertical beam 910 is connected to the second end of the first diagonal truss member 2 and the first end of the horizontal member 4 at the apex 3 using structural pins, bolts or weldments. Similarly, the second end of the second short vertical beam 911 is connected to the second end of the horizontal member 4 and the first end of the second diagonal truss member 6 at the apex 5 using structural pins, bolts or weldments. The first end bracket 812 is provided with means for structural attachments 814, 815 which may be pins, bolts or weldments. Likewise, the second end bracket 813 is provided with means for structural attachments 814, 820 (e.g., pins, bolts, weldments). The first short vertical beam 910 is attachable to the girder 8 with structural attachments 816, 817 (e.g., pins, bolts, weldments) and the second short vertical beam 911 is attachable to the girder 8 with structural attachments 818, 819 (e.g., pins, bolts, weldments).

A first tension chord 840 having a first end and a second end extends between the first end bracket 812 and the first end of the first short vertical beam 910. A second tension chord 841 having a first end and a second end extends between the first end of the first short vertical beam 910 and the first end of the second short vertical beam 911. A third tension chord 842 having a first end and a second end extends between the first end of the second short vertical beam 911 and the second end bracket 813.

Figure 10:
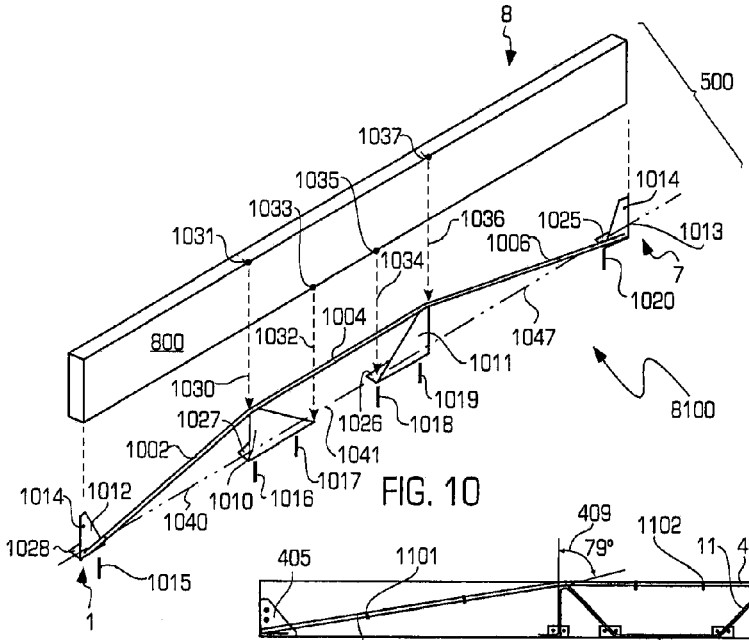
FIG. 10 is an arrangement of the invention showing the saddles and connections associated with the enhancing mechanism where the enhancement acts on only one side of the primary girder.

FIG. 10 is an enhanced girder system 500 showing the enhancing mechanism 8100 in combination with a girder 8 such that the enhancing mechanism fits within the dimensions of the girder web 800. Unlike in the embodiment of FIG. 8, where the enhancing mechanism "caged" the girder 8 from three sides, the enhancing mechanism supports the girder 8 from only two sides in this embodiment. Alignment lines 1030, 1032, 1034, 1036 illustrate how the girder 8 fits over the first and second short vertical beams 1010, 1011. The first diagonal truss member 1002, the horizontal member 1004, and the second diagonal truss member 1006 form a continuous structure coupled to the first and second short vertical beams 1010, 1011. The first diagonal truss member 1002 is connected at its second end to a first end bracket 1012 and the diagonal truss member 1006 is connected at its second end to a second end bracket 1013. Each of the first and second end brackets 1012, 1013 is fitted with a connection fixture 1028, 1025. The first and second end brackets 1012, 1013 are fixed to the girder 8 with structural connectors 1014, 1015, 1020. The first short vertical beam 1010 having a first end and a second end is provided with a surface 1027 at the first end for the purpose of connecting to the girder sidewall 800 substantially at position 1033. The connection of the surface 1027 to the girder 8 uses structural attachments 1016, 1017. The second end of the first short vertical beam 1010 offers no provision for connections to the girder 8 and is free of the girder 8 substantially at the point 1031. The second short vertical beam 1011 having a first and second end is provided with a surface 1026 at the first end for the purpose of connecting to the girder sidewall 800 substantially at the point 1035. A first tension chord 1040 connects the bracket 1012 with the first end of the first short vertical beam 1010. A second tension chord 1041 connects the first ends of the first and second short vertical beams 1010, 1011. A third tension chord 1047 connects the short vertical beam 1011 with the second end bracket 1013. The first and second end brackets 1012, 1013 are located at the end points 1, 7. The connection of the surface 1026 to the girder 8 uses structural attachments 1018, 1019. The second end of the second short vertical beam 1011 offers no provision for connections to the girder 8 and is free from the girder 8 substantially at the point 1037.

Figure 11:
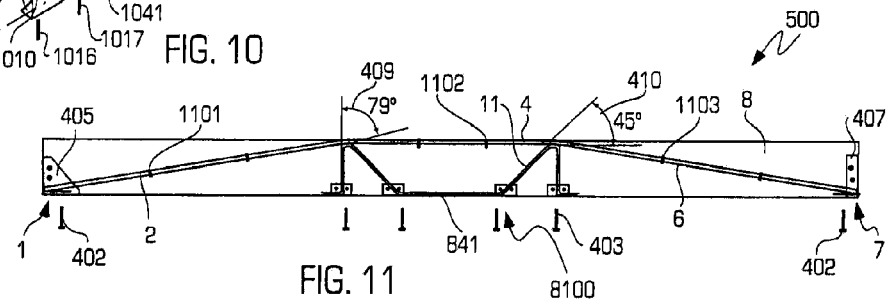
FIG. 11 details a method for providing intermediate support for the compression struts of the enhancing mechanism, to reduce the effects of Euler buckling.

FIG. 11 is an enhanced girder including the enhancing mechanism 8100 and the girder 8 where the first diagonal truss member 2, the horizontal member 4, and the second diagonal truss member 6 form a continuous compression structure. The configuration of FIG. 11 is useful for providing intermediate support for the compression struts of the enhancing mechanism 8100, thereby reducing the effects of Euler buckling.

Each of these members, 2, 4, 6, is constrained against Euler type buckling by clips 1101, 1102, 1103 placed at intervals along each member's length. For example, in this embodiment, the first diagonal truss member 2 is constrained by clips 1101 placed at intervals along its length and secured to the girder 8. The horizontal member 4 is constrained by clips 1102 placed at intervals along its length and secured to the girder 8. The second diagonal truss member 6 is constrained by clips 1103 placed at intervals along its length and secured to the girder 8. The girder 8 having the first end 1 and the second end 7 is fitted with a first and second end brackets 405, 407. The end brackets 405, 407 are shown to be of different designs in FIG. 11 but they are not limited to any specific design. The end brackets 405, 407 may both look like the first end bracket 405, both look like the second end bracket 407, or look like a third bracket that is not shown, as long as they fix or support the ends 1, 7. Each end bracket is fixed to the girder 8, using structural pins or bolts 402. A tension chord 841 is shown in association with the enhancing mechanism 8100 and the girder 8. The tension chord 841 is fixed to the girder 8 using structural pins or bolts 403. The first and second diagonal truss members 2, 6 are set to the vertical by an angle 409. The second diagonal segment 11 is set to the horizontal by an angle 410, which in this example is about 45°. One or more of the enhancing mechanism 8100 shown in FIG. 11 may be combined with a girder 8.

Figure 12:
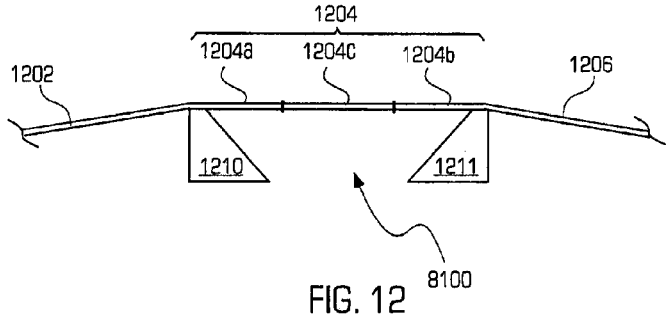
FIG. 12 shows an enhancing mechanism including an insertion link for adjusting the length of the mechanism.

FIG. 12 diagrams a part of the enhancing mechanism 8100 which shows the element of the continuous compression boundary composed of the first diagonal truss member 1202, the horizontal member 1204, and the second diagonal truss member 1206. These boundary members are connected in combination with the first and second short vertical beams 1210, 1211. In this particular embodiment, the horizontal member 1204 is divided into two physically separable links: a first link 1204*a* and a second link 1204*b*. A third link 1204*c* may be detachably engaged to the first link 1204*a* and a second link 1204*b* to achieve a desired length of the enhancing mechanism 8100. "Insert" links like the third link 1204*c*, whose length may be selected to be appropriate for the intended application, allows flexibility to be built into the length of the enhancing mechanism 8100. For example, with the incorporation of the third link 1204*c*, an enhancing mechanism 8100 can be sold or marketed for being usable with girders a range of lengths rather than for girders of one specific length. Generally, the length of the enhancing mechanism 8100 is substantially equal to the length of the girder 8, although this may not be desirable in some cases.

Figure 13:
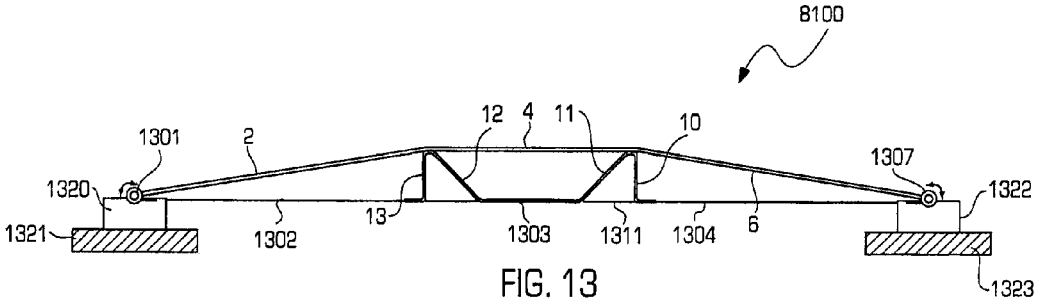
FIG. 13 shows an end connection providing a lateral restraint to the compression boundary of the enhancing mechanism.

FIG. 13 depicts the enhancing mechanism 8100 positioned between two fixed abutments 1321, 1323, which do not allow lateral expansion of the tension chords 1302, 1303, 1304, 1311. A first and second rotating support structures 1301, 1307 of the enhancing mechanism 8100 are each fixed by structures 1320, 1322. The structures 1320, 1322 rotate in the direction shown by the arrows but not laterally (into and out from the page). The enhancing mechanism 8100 includes a first diagonal truss member 2, a second diagonal truss member 6, a first truss segment 13, a first diagonal segment 12, a second diagonal segment 11, a second truss segment 10, and a horizontal member 4.

Figure 14:
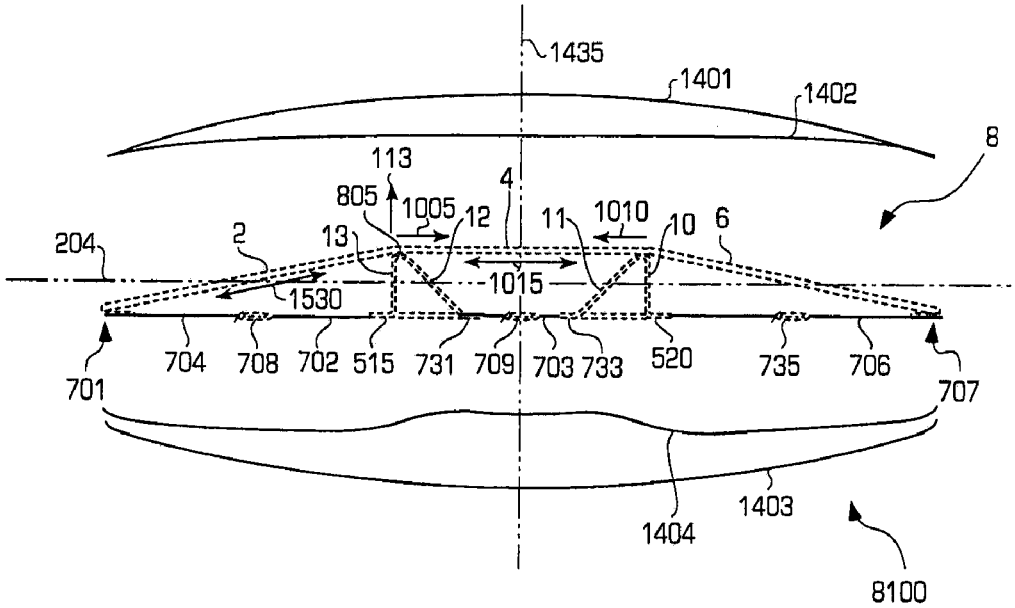
FIG. 14 illustrates how the enhancing mechanism redistributes the stress levels in bending of the girder.

FIG. 14 illustrates how the enhancing mechanism 8100 redistributes the stress levels in the bending of the girder. FIG. 14 displays physical reactions of the girder 8 to a uniform load applied to an enhanced girder, which includes the enhancing mechanism 8100 and the girder 8. A girder 8 acting separately and experiencing a uniformly distributed load will exhibit a bending moment 1401 where a maximum is developed at a point located on an axis 1435 and will deflect (i.e., bend) in the shape depicted by a line 1403 such that a maximum bending will be developed along a point on the axis 1435. The axis 1435 is located on the lengthwise midpoint of the enhancing mechanism 8100. The first diagonal truss member 2 forms a continuous compression structure with the horizontal member 4 and the second diagonal truss member 6, and the first truss segment member 13 acts in association with the first diagonal segment 12 to form a reactive lever against the girder 8, and the second truss segment member 10 acts in association with the second diagonal segment 11 to form a reactive lever against the girder 8. The first positive maximum bending moment indicated by a curve 1402 now occurs between the first end 701 of the girder 8 and the first truss segment 13. The second positive maximum bending moment now occurs between the second end 707 of the girder 8 and the second truss segment 10. This distribution of the bending moment and reduction of deflection 1404 also effectively decreases the net maximum bending moment in the girder 8 and as a consequence, decreases the net energy requirements of the girder 8. Reducing the energy requirements of the primary girder also reduces the girder cross sectional area.

FIG. 14 illustrates how the preferred embodiment of the enhancing mechanism 8100 works together with the first diagonal truss member 2, the second diagonal truss member 6, and the girder 8 to distribute and reduce the maximum bending moment of the girder 8 and reduce the deflection of the girder 8 when a uniform load is applied to the girder 8. As the girder 8 attempts to deflect down under the influence of an applied load, the first truss segment 13 and the second truss segment 10 exert forces that are transferred directly to the girder 8 at their respective connectors 515, 520 as shown by force vectors 1005, 1010. The triangle formed by the first truss segment member 13 and the first diagonal segment 12 and the triangle formed by the second truss segment member 10 and the second diagonal segment 11 exert forces on the girder 8. The triangles act primarily below the neutral axis 204 of the girder, at a region on the axis 1435, and at the first and second structural connectors 515, 520 where the first and second truss segments 13 and 10 are located. The forces are superposed with the normal internal forces of the girder 8 to create a modified moment (shown by the curve 1402) in the girder 8 as it experiences "beam action".

The first and second diagonal truss members 2, 6 develop a compressive stress 1530 consistent with the compressive stress 1015 in the horizontal member 4. A statical reaction upward (shown by an arrow 113) and perpendicular to the girder 8 is created at structural connectors 515, 520.

The compressive reactions of the enhancement require equal and opposite reactions at the end points 701, 707 of the enhancement. This reaction is in part tension and can be provided by the girder 8 or an external element such as a tension chord 703, 704, 706 in the invention. In the arrangement described, where the line of force from the enhancement is below the neutral axis 204 of the girder, forces developed by the enhancing mechanism 8100 are transferred to the girder 8 by structural connections. In the invention, the line of effort of the enhancing mechanism is placed below the neutral axis 204 of the girder. In association with the tension chord, tension adjusters 708, 709, 735 are provided to pre-tension the tension chords 703, 704, 706, respectively. The structural connectors, 515, 731, 733, 520 act upon the girder and alter the deflection 1404.

The connections at the base of the girder 8 constitute structural joints. These connections transfer the whole loads developed at these points to the girder 8.

The enhancement is a mechanism that modifies the girder reactions and stresses. Pins and connections to the girder 8 at the base of the tension chord modify the girder reactions and internal stresses.

Figure 15:
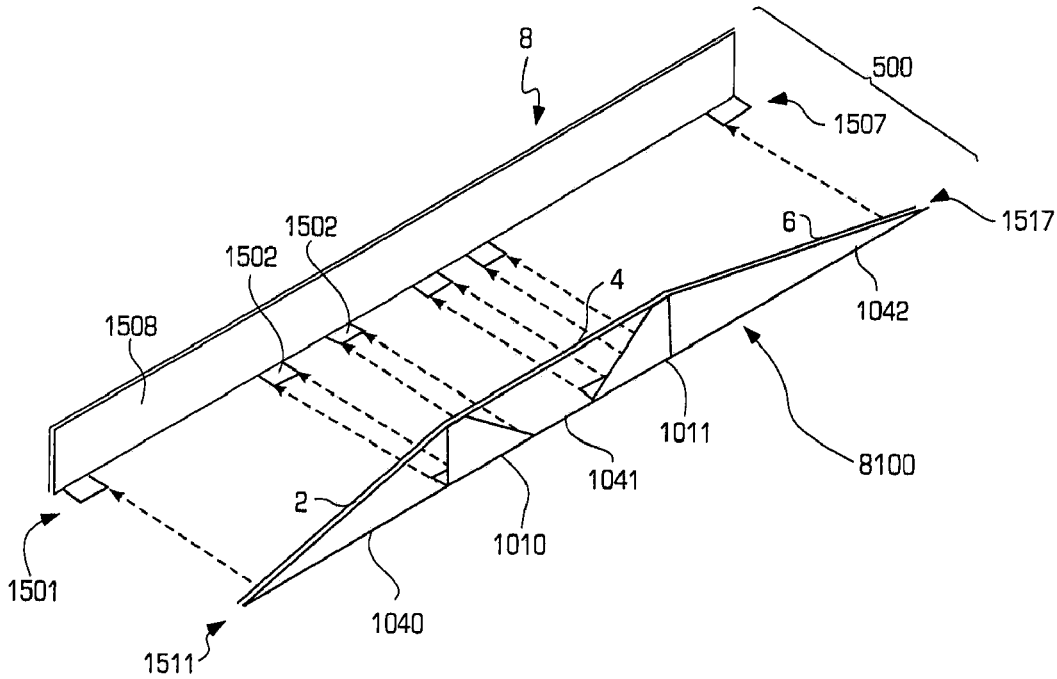
FIG. 15 is an embodiment of a superposed enhancing segment that is connected to one vertical plate element in association with the first and third truss segments as essentially vertical plate elements exhibiting beam action.

FIG. 15 is an enhanced girder system 500 including a girder 8 with connection points created by structural joints or tabs 1502. which connect to the vertical beam elements 1010 and connection points 1501, 1507 created by the structural joints or tabs 1501, 1507. The end tabs 1501, 1507 connect to the first and second end points 1511, 1517 of the enhancing mechanism 8100. The first and second diagonal truss members 2, 6 are connected to the horizontal member 4 at the second ends of the vertical beam elements 1010, 1011. The first tension chord 1040 is connected to the first end point 1511 and the first end of the vertical beam element 1010. A second tension chord 1041 is connected between the first ends of the vertical beam elements 1010, 1011. A third tension chord 1042 is connected between the first end of the vertical beam element 1011 and the second end 1517 of the second diagonal truss member 6. The tabs 1502 are aligned with the vertical beam elements 1010, 1011 as shown by the arrows.

The above descriptions apply to preferred embodiments of the arrangement of a mechanism which is fitted within the length and height of a traditionally configured girder. The mechanism is superposed upon or combined with the girder it enhances, and the assembly is described above as a specific series of connections and members that develop and fix the superposition. There are many variations possible within the mechanics of the structure represented. For example, the members of the enhancement may be adjustable so that one assembly may be adjusted to fit a variety of girders. The tension chord(s) of the invention may be constructed as a part of the girder, providing pre-built attachments on the girder itself that fit the requirements of the enhancement. The girder and the enhancement may be of different materials with different elasticity, allowing composite construction to take advantage of light weight materials. Therefore, the scope of the invention should be determined by the appended claims and their legal equivalents, not by the exemplary embodiments provided herein.

What is claimed is:

1. A girder system for distributing a bending moment of the girder under a uniform applied load, the girder system comprising:

a girder having a neutral axis extending through its length; and an enhancing mechanism coupled to the girder such that the enhancing mechanism is positioned primarily below the neutral axis, wherein the enhancing mechanism has:

a first truss segment and a second truss segment positioned substantially parallel to each other;

a first diagonal segment and a second diagonal segment positioned between the first truss segment and the second truss segment, wherein the first diagonal segment and the second diagonal segment are coupled to the first truss segment and a second truss member at an angle, respectively;

a horizontal member connecting one end of the first truss segment to one end of the second truss segment; and first and second diagonal truss members coupled to the one end of the first truss segment and the one end of the second truss segment, respectively, and extending in different directions than the first diagonal segment and the second diagonal segment.

2. The girder system of claim 1, wherein the enhancing mechanism is coupled to the girder only at points below the neutral axis of the girder.

3. The girder system of claim 1, wherein the enhancing mechanism fits inside the outer boundaries of the girder.

4. The girder system of claim 3, wherein the girder has a box structure and the enhancing mechanism is slid into the box structure.

5. The girder system of claim 3, wherein the girder has a sidewall, a top flange, and a bottom flange, and wherein the enhancing mechanism is positioned against the sidewall between the top flange and the bottom flange.

6. The girder system of claim 5, wherein a first enhancing mechanism is positioned against a first surface of the sidewall and a second enhancing mechanism is positioned against a second surface of the sidewall that is parallel to the first surface.

7. The girder system of claim 6, wherein the first enhancing mechanism is positioned against the first surface in the same manner the second enhancing mechanism is positioned against the second surface.

8. The girder system of claim 3, wherein the girder has a sidewall and the enhancing mechanism is coupled to the sidewall with brackets and an attaching device.

9. The girder system of claim 8, wherein the girder has a first enhancing mechanism coupled to a first surface of the sidewall and a second enhancing mechanism coupled to a second surface of the sidewall that is parallel to the first surface.

10. The girder system of claim 3, wherein the girder comprises a first sidewall and a second sidewall that are engaged with each other to form the girder, and wherein the enhancing mechanism is contained between the first sidewall and the second sidewall.

11. The girder system of claim 1, wherein the girder has a base establishing a lower boundary of the girder, wherein the enhancing mechanism is coupled to the base.

12. The girder system of claim 1, wherein the girder is made of a different material from the enhancing mechanism.

13. The girder system of claim 1, wherein the girder is placed in the enhancing mechanism such that the enhancing mechanism at least partially frames the girder.

14. The girder system of claim 13, wherein the enhancing mechanism comprises:

a first parallel companion truss member that is positioned parallel to the first diagonal truss member and separated from the first diagonal truss member by a predetermined distance;

a second parallel companion truss member that is positioned parallel to the second diagonal truss member and separated from the second diagonal truss member by the predetermined distance; and a companion horizontal member that is positioned parallel to the horizontal member and separated from the horizontal member by the predetermined distance, wherein the predetermined distance is approximately equal to a thickness of the girder.

15. The girder system of claim 14, wherein the first truss segment and the first diagonal segment are designed in the form of a first short vertical beam having a base and the second truss segment and the second diagonal segment are designed in the form of a second short vertical beam also having a base.

16. The girder system of claim 15, wherein the first short vertical beam has a first supporting base and the second short vertical beam has a second supporting base, wherein the first and second supporting bases hold the girder and at a lower boundary of the girder system.

17. The girder system of claim 13, wherein the first truss segment and the first diagonal segment are incorporated into a first short vertical beam having a base and a first supporting base, and the second truss segment and the second diagonal segment are incorporated into a second short vertical beam having a base and a second supporting base, wherein the first and second supporting bases are designed to hold the girder.

18. The girder system of claim 17, wherein the girder is attached to the first and the second supporting bases via structural attachments.

19. The girder system of claim 17 further comprising:

a first end bracket attached to the first diagonal truss member at an end that is not attached to the first short vertical beam; and a second end bracket attached to the second diagonal truss member at an end that is not attached to the second short vertical beam, wherein the first and second end brackets are attached to the girder.

20. The girder system of claim 1, wherein the enhancing mechanism comprises a set-of tension chords.

21. The girder system of claim 1, wherein the enhancing mechanism includes a set of tension chords comprising:

a first tension chord connecting the first diagonal truss member to the first truss segment;

a second tension chord connecting the first diagonal segment to the second diagonal segment; and a third tension chord connecting the second diagonal truss member to the second truss segment.

22. The girder system of claim 21 further comprising:

a fourth tension chord connecting the first truss segment to the first diagonal segment; and a fifth tension chord connecting the second truss segment to the second diagonal segment.

23. The girder system of claim 20 further comprising at least one tensioning device for controlling a tension level in the set of tension chords.

24. The girder system of claim 1, wherein each of the first and second truss segments has a first end and a second end, wherein each first end is attached to the first diagonal truss member and the second diagonal truss member, respectively, and each second end is attached to the girder.

25. The girder system of claim 24, wherein each first end is also attached to different ends of the horizontal member.

26. The girder system of claim 1, wherein each of the first and second diagonal segments has a first end and a second end, wherein each first end is attached to first ends of first truss segment and the second truss segment, respectively, and each second end is attached to the girder.

27. The girder system of claim 1, wherein each of the first and second diagonal truss members has a first end and a second end, wherein the first ends are attached to the first and second truss segments, respectively, and the second ends are attached to the girder.

28. The girder system of claim 1, wherein each of the first and second diagonal truss members has a first end and a second end, wherein the first ends are attached to the first and second truss segments, respectively, and the second ends are attached to rotating support structures that accommodate movements along a lengthwise direction of the girder.

29. The girder system of claim 1, wherein the horizontal member of the enhancing mechanism comprises a first link, a second link, and a third link, wherein the third link is disengageably connected between the first link and the second link to adjust a length of the horizontal member.

30. The girder system of claim 1, wherein the enhancing mechanism is positioned substantially near a point along the length of the girder that typically experiences maximum bending moment.

31. A girder system for distributing a bending moment at a midpoint region of the girder under a uniform applied load, the girder system comprising:

a girder having a neutral axis extending through its length; and an enhancing mechanism coupled to the girder such that the enhancing mechanism is coupled to the girder such that the enhancing mechanism is positioned primarily below the neutral axis, wherein the enhancing mechanism has:

a first short vertical beam having a first base;

a second short vertical beam having a second base;

a horizontal member connecting a top of the first short vertical beam to a top of the second short vertical beam;

a first diagonal truss member having a first end and a second end, wherein the first end is coupled to the top of the first short vertical beam and the second end is coupled to the girder; and a second diagonal truss member having a first end and a second end, wherein the first end is coupled to the top of the second short vertical beam and the second end is coupled to the girder.

32. The girder system of claim 31 wherein the first short vertical beam has a first supporting base connected to a side of the first base and the second short vertical beam has a second supporting base connected to a side of the second base, wherein the first and second supporting bases support the girder.

33. The girder system of claim 31, wherein the enhancing mechanism is coupled to the girder only at points below the neutral axis of the girder.

34. The girder system of claim 31, wherein the enhancing mechanism fits inside the outer boundaries of the girder.

35. The girder system of claim 34, wherein the girder has a box structure and the enhancing mechanism is slid into the box structure.

36. The girder system of claim 34, wherein the girder has a sidewall, a top flange, and a bottom flange, and wherein the enhancing mechanism is positioned against the sidewall between the top flange and the bottom flange.

37. The girder system of claim 31, wherein the girder has a base establishing a lower boundary of the girder, wherein the enhancing mechanism is coupled to the base.

38. The girder system of claim 31, wherein the girder is made of a different material from the enhancing mechanism.

39. The girder system of claim 31, wherein the girder is placed in the enhancing mechanism such that the enhancing mechanism at least partially frames the girder.

40. The girder system of claim 31, wherein the enhancing mechanism comprises a tension chord.

41. A method of distributing a bending moment of the girder under a uniform applied load, the method comprising:

providing a girder having a neutral axis extending through its length;

providing an enhancing mechanism that has a first truss segment and a second truss segment positioned substantially parallel to each other;

a first diagonal segment and a second diagonal segment positioned between the first truss segment and the second truss segment, wherein the first diagonal segment and the second diagonal segment are coupled to the first truss segment and a second truss segment, respectively;

a horizontal member connecting one end of the first truss segment to one end of the second truss segment; and a first and second diagonal truss members coupled to the one end of the first truss segment and the one end of the second truss segment, respectively, and extending in different directions than the first diagonal segment and the second diagonal segment; and coupling the girder and the enhancing mechanism such that the enhancing mechanism is positioned primarily below the neutral axis.

42. The method of claim 41 further comprising coupling the girder and the enhancing mechanism only below the neutral axis of the girder.

43. The method of claim 41, wherein coupling the girder and the enhancing mechanism comprises sliding the enhancing mechanism into a box structure of the girder.

44. The method of claim 43, wherein coupling the girder and the enhancing mechanism comprises positioning a first enhancing mechanism against one surface of the sidewall and positioning a second enhancing mechanism on another surface of the sidewall that is parallel to the one surface.

45. The method of claim 41, wherein coupling the girder and the enhancing mechanism comprises welding the enhancing mechanism to the girder.

46. The method of claim 41, wherein coupling the girder and the enhancing mechanism comprises using brackets.

47. The method of claim 41, wherein coupling the girder and the enhancing mechanism comprises using screws or bolts.

48. The method of claim 41, wherein the enhancing mechanism also has:

a first parallel companion truss member that is positioned parallel to the first diagonal truss member and separated from the first diagonal truss member by a predetermined distance;

a second parallel companion truss member that is positioned parallel to the second diagonal truss member and separated from the second diagonal truss member by the predetermined distance; and a companion horizontal member that is positioned parallel to the horizontal member and separated from the horizontal member by the predetermined distance, wherein the predetermined distance is approximately equal to a thickness of the girder;

wherein coupling the girder and the enhancing mechanism comprises positioning the girder between the first and second diagonal truss members and their parallel companion truss members.

49. The method of claim 41, wherein the girder has a first part and a second part, wherein coupling the girder and the enhancing mechanism comprises positioning the enhancing mechanism between the first part and the second part of the girder and attaching the first part to the second part.

50. The method of claim 41 further comprising connecting portions of the enhancing mechanism with a tension chords.

51. The method of claim 41, further comprising, connecting portions of the enhancing mechanism including:

connecting the first diagonal truss member to the first truss segment with a first tension chord;

connecting the first diagonal segment to the second diagonal segment with a second tension chord; and connecting the second diagonal truss member to the second truss segment with a third tension chord.

52. The method of claim 51 further comprising:

connecting the first truss segment to the first diagonal segment with a fourth tension chord; and connecting the second truss segment to the second diagonal segment with a fifth tension chord.

53. The method of claim 50 further comprising adjusting a tension level of the tension chord with a tensioning device incorporated into the enhancing mechanism.

54. The method of claim 41, wherein each of the first and second truss segments has a first end and a second end, further comprising:

attaching the first end of the first truss segment to the first diagonal truss member;

attaching the first end of the second truss segment to the second diagonal truss member; and attaching the second ends of the first truss segment and the second truss segment to the girder.

55. The method of claim 54 further comprising attaching the first end of the first truss segment and the first end of the second truss segment to different ends of the horizontal member.

56. The method of claim 41, wherein each of the first and second diagonal segments has a first end and a second end, wherein coupling the girder and the enhancing mechanism comprises:

attaching the first end of the first diagonal segment to the first truss segment;

attaching the first end of the second diagonal segment to the second truss segment; and attaching the second ends of the first diagonal segment and the second diagonal segment to the girder.

57. The method of claim 41, wherein each of the first and second diagonal truss members has a first end and a second end, and wherein coupling the girder and the enhancing mechanism comprises:

attaching the first end of the first diagonal truss member to the first truss segment;

attaching the first end of the second diagonal truss member to the second truss segment; and attaching the second ends of the first and second diagonal truss members to the girder.

58. The method of claim 41, wherein each of the first and second diagonal truss members has a first end and a second end, further comprising:

attaching the first end of the first diagonal truss member to the first truss segment;

attaching the first end of the second diagonal truss member to the second truss segment; and attaching the second ends of the first and second diagonal truss members to rotating support structures that accommodate movements along a lengthwise direction of the girder.

59. The method of claim 41 further comprising adjusting a length of the enhancing mechanism by adding an extension link to the horizontal member.

60. The method of claim 41, wherein coupling the girder and the enhancing mechanism comprises positioning the enhancing mechanism along the length of the girder that typically experiences maximum bending moment.

61. The method of claim 41, wherein the girder has a sidewall, a top flange, and a bottom flange, and wherein coupling the girder and the enhancing mechanism comprises positioning the enhancing mechanism against the sidewall between the top flange and the bottom flange.

* * * * *